United States Patent [19]

Jonsson

[11] Patent Number: 4,854,763

[45] Date of Patent: Aug. 8, 1989

[54] DEVICE FOR THE IMPALING OF LOOSE LEAVES

[75] Inventor: Magnus Jonsson, Lund, Sweden

[73] Assignee: Inter-Ikea A/S, Denmark

[21] Appl. No.: 192,295

[22] Filed: May 10, 1988

[30] Foreign Application Priority Data

May 11, 1987 [DK] Denmark ..... 2376/87

[51] Int. Cl.[4] ..... B42F 13/20; B42F 3/04; B42F 13/26; A47F 7/00

[52] U.S. Cl. ..... 402/32; 402/31; 402/39; 211/57.1

[58] Field of Search ..... 402/29, 31, 38, 33, 402/34, 39; 40/104.13; 211/7, 8, 9, 46, 47, 94, 162, 57.1

[56] References Cited

U.S. PATENT DOCUMENTS

| | | | |
|---|---|---|---|
| 1,027,085 | 5/1912 | Stbin | 402/32 |
| 1,042,626 | 10/1912 | Watson | 402/32 |
| 1,048,852 | 2/1912 | Morden | 402/32 |
| 1,867,164 | 7/1932 | Lotter | 402/32 |
| 1,982,409 | 11/1934 | Adams | 402/32 |
| 2,036,853 | 4/1936 | Crall | 402/32 |
| 3,252,461 | 5/1966 | Schade | 402/31 |

*Primary Examiner*—Frank T. Yost
*Assistant Examiner*—Paul M. Heyrana

[57] ABSTRACT

A device for impaling loose leaves, such as a loose leaf binder (1) comprising two or more holding means (14) provided with for example rings or gripping fingers (10) fastened to one or more guide or guide members (5, 15). The holding means (14) of the device are mutually displaceable in one direction with respect to the individual guide member (5, 15) and detachably fastened thereto, said holding means (14) being preferably stepwise displaceable in said direction being the longitudinal direction of the loose leaves. The inventive device enables the manufacture of loose leaf binders without regard of which country or area the binder is to be used in. It is possible to move the individual rings or gripping fingers (10) with respect to each other as well as, if necessary, to provide the binder with extra rings or gripping fingers (10). The device also enables other equipment to be placed in the binder, such as pencil holders or holders for notepads or the like.

10 Claims, 3 Drawing Sheets

DEVICE FOR THE IMPALING OF LOOSE LEAVES

FIELD OF THE INVENTION

The invention relates to a device for impaling loose leaves, such as a loose leaf binder comprising two or more holding means provided with for example rings or gripping fingers fastened to one or mroe guide or guide members.

BACKGROUND ART

The Swedish accepted published application No. 423.984 discloses a loose leaf binder with gripping fingers mounted on plates pushed into grooves so that the fingers of the loose leaf binder are adaptable to the punch standards of the material to be inserted in the loose leaf binder. The disadvantage of this device is that the plates are unmovable in the grooves once their position has been determined. Moreover, the plates are fastened by means of deforming. As a result it is impossible to move the plates lateron.

The Danish patent specification No. 40.461 discloses an assembly for collecting loose leaves, where the fingers (or rings) are mutually displaceable, so that it is possible to move sheets of paper with respect to each other. A disadvantage of this assembly is that the rings cannot be adapted to various punch standards, i.e. the rings are positioned once and for all at a predetermined distance and thus adapted to a concrete punch standard.

SUMMARY OF THE INVENTION

The object of the present invention is to provide a device of the type mentioned in the introduction enabling in a simple manner the retention of a number of holding means corresponding to the number of punched holes in the sheet to be inserted in the device, and at the same time enabling the adjustment of the mutual distance of the holding means so that the device is suitable for different punch standards and can be delivered to the customer in one planar piece.

According to the invention the holding means of the device are mutually displaceable in one direction with respect to the individual guide member and detachably fastened thereto, said holding means being preferably stepwise displaceable in said direction being the longitudinal direction of the loose leaves.

As a result many holding means corresponding to many holes in the sheets to be held can be used in a simple manner. Moreover the holding means are easily moved to the positions corresponding to a given punch standard. When the device is to be used for sheets punched in a standard different from the one previously used the holding means are easily released and positioned according to the new standard. It is thus possible to manufacture a large series of devices to be adaped to the local standards of a number of areas (countries) instead of manufacturing several small series adaped to the needs of each of these areas (countries). Delivering the device in one planar piece results in small space requirements. In order to prepare the device, the user inserts the clamping means (to be packed separately) into the guide member in the desired position, and the device is thus ready for use. As a result the manufacturing costs of the inventive device are small and it is univerally usable.

In one embodiment holding means of the inventive device comprises a clamping means displaceably and detachably fastened in a groove of the guide member or members, said groove having a half opened cross-section, such as a dovetail, and said clamping means being preferably of short length compared to the length of the guide member. As a result the holding means snugly sit close to each other while still being movable in the guide member.

In another embodiment of the invention for use in a loose leaf binder with two board parts and one back part the two guide members are mounted each on one board part, or both on the back part, or that the two guide members are mounted in such a way that one is on the back part and the other is on one of the board parts. Thus the sheets are movable on the gripping fingers used when one part of said gripping finger is positioned on a clamping means of one of the guide members and the other part of the gripping finger is positioned on a clamping means of the second guide member and the two guide members are fastened with respect to each other. When the guide members are turned away from each other the sheets can be removed from the gripping fingers.

The guide member or members are, according to the invention provided with a row of projections forming adjustment steps. As a result the rings or gripping fingers are displaceable and individually lockable and thus adaptable to the punched holes in the sheets to stored in the binder.

In yet another embodiment the holding means has clamping means provided with locking means to be engaged between the projections and subsequently locked thereto. This results in a reliable hold of the rings or gripping fingers in the guide member once a position has been determined.

Furthermore, the locking means are, according to the invention, retained in the guide members by means of the spring action of adjacent parts. Thus the spring action caused, for example, by the shape of the guide member or the clamping means is used to lock the rings or gripping fingers.

In a further embodiment of the invention the projections are placed along the entire length of the guide member or members in one or two rows, and the projections of the individual row are preferably parallel to each other. As a result the guide members are manufactured by the meter and are cut to the required length, thus making the manufacture less expensive.

In yet a further embodiment of the invention the projections are positioned with a mutual distance corresponding to various punch standards, enabling the positioning of the rings or gripping fingers exactly where required by a given punch standard.

In another embodiment of the invention the clamping means contributes to the spring action, and the spring action is triggered, i.e. reduced, by flexing the guide member. As a result the holding means are movable with respect to the guide member when said guide member is flexed—either over the edge of a table or desk or over the knee. If the device is subsequently released the guide member straightens out again holding the rings or gripping fingers.

In yet another embodiment the retention of the locking means between the projections is achieved by means of a web made of resilient material and placed on the clamping means, said web being provided with a hook close to the end furthest away from the rings or gripping fingers, said hook meshing between the projections and being removable from the projections when the web is pressed down into the groove, such as by manually exerted pressure on its middle. Thus the rings or gripping fingers are movable by using either a finger or a pencil or the like for pressing the web when the position of the rings or gripping fingers is to be altered.

According to the invention the projections are rectangular and preferably equidistantly spaced. As a result, the edge absorbing the forces the guide member is exposed to by the rings or gripping fingers is perpendicular to the movement or load the binder is subjected to by the rings or gripping fingers. This enables the guide member to transfer the largest possible forces.

In a last embodiment of the inventive device the hook is wedge-shaped, this being the most suitable form for retention between the projections.

BRIEF DESCRIPTION OF THE DRAWINGS

The invention is described in greater detail below and with reference to the accompanying drawings in which.

DETAILED DESCRIPTION OF THE INVENTION

Figure 1:
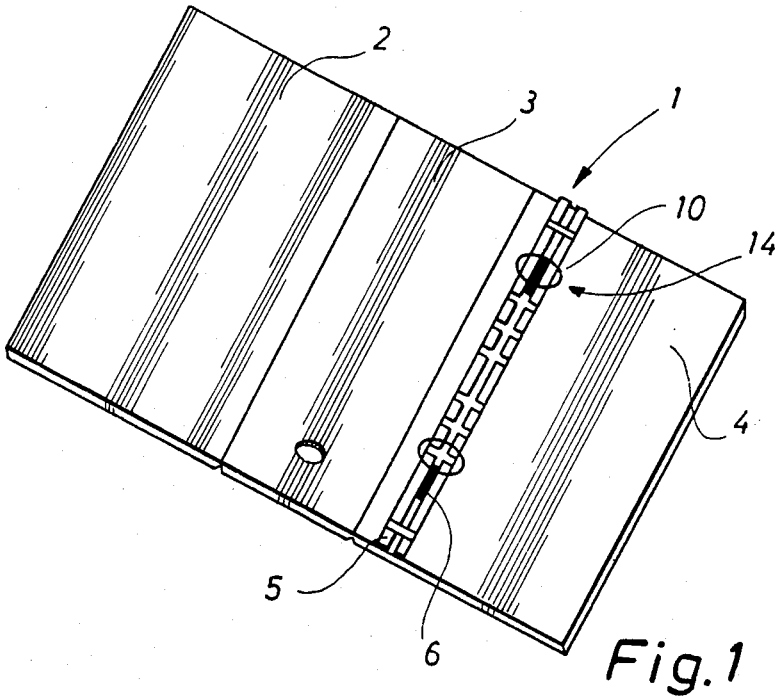
FIG. 1 is a perspective view of the embodiment of the device in connection with a binder.

FIG. 1 illustrates a device 1 for impaling loose leaves in connection with a loose leaf binder. The device has holding means in form of rings or gripping fingers 10 positioned in a guide member in form of a rail 5 on one board part 4 of the binder. Furthermore the binder comprises a back part 3 and a second board part 2. The rings 10 are displaceable along the rail 5 so that they are adaptable to the holes in sheets to be inserted in the binder. The rings 10 are displaceable along the rail 5 in a direction parallel to the sheets in the binder. The device may also be used to keep computer printouts often having unusual sizes. In this case it is important that the holding means are shaped in such a way that they are able to impale the small holes used for feeding the printouts. All types of gripping fingers available on the market may be used. These include gripping fingers where the two parts are kept together by means of springs, or gripping fingers pushed into each other or adjacent each other through the same hole. The gripping fingers can also be of the type coming into engagement through two different holes froom each side or of the type where a screw assembly with a head impales the holes with the screw screwed down into the clamping means. It is also possible to fasten other types of equipment to the rail, such as equipment to be used in binders for holding course or conference material. This includes pencil holders or holders for other forms of writing materials or e.g. a watch or small holders for note paper, a notepad, clips or the like.

Figure 2:
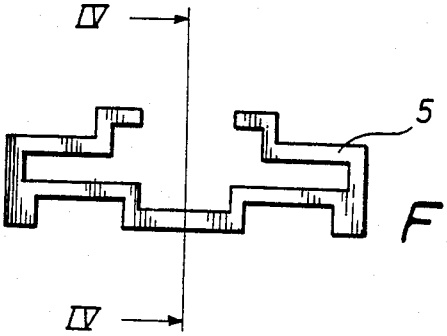
FIG. 2 is an end view of a guide member of the invention in form of a rail.

FIG. 2 is an end view of a rail 5. The form of the rail 5 depends on the strength it is to have and the way it is manufactured and mounted in the binder. The width of the rail depends on the amount of paper it has to carry and which torque it is exposed to. The cross-section of the rail can have the shape of any type of dovetail rail so that the clamping means of the rings are securely retained. The form of cross-section of FIG. 2 is suitable for extrusion moulding of e.g. aluminum. It is also possible to manufacture the rail in form of steel plates to be pressed, bent or stamped and subsequently punched and welded. Such a cross-section is of slightly different shape than the one manufactured by extrusion moulding. The rail can also be formed in such a way that the clamping means surround it. Each rail is fastened to the binder by means of rivets or glue, or it is cast into the binder.

Figure 3:
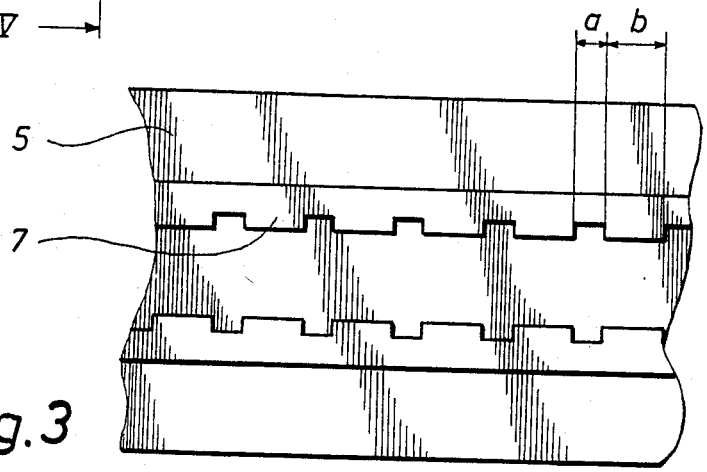
FIG. 3 is a top view of the rail of FIG. 2.

FIG. 3 is a top view of the rail of FIG. 2. The rail 5 is provided with projections 7. Between the projections there are notches for receiving a hook of a locking means to be described in greater detail below in connection with FIGS. 4 and 5. The rail 5 can be manufactured by the meter and cut into appropriate lengths. The projections 7 are preferably equidistantly spaced and can for example be manufactured by means of being punched out of the rail, or by cutting flutes across the rail, or by means of milling. Depending on the use of the binder the projections 7 are equidistantlay spaced or they are positioned in accordance with given punch standards, cf. FIG. 7. The user might wish not to use a predetermined standard, since there are a lot of sheets having previously been stored in a binder, the holes of said sheets having been destroyed beyond repair, thus making it desirable to punch new holes between the old ones so that the sheets can remain in the binder. The new holes are, of course of a different standard than the old ones. The user might also have a binder having been used so frequently that the holes in the sheets are worn out. It may then be suitable to provide the binder with more rings or gripping fingers than is customary of the standard used. The extra rings or gripping fingers impale extra holes to be punched into the sheets.

Figure 4:
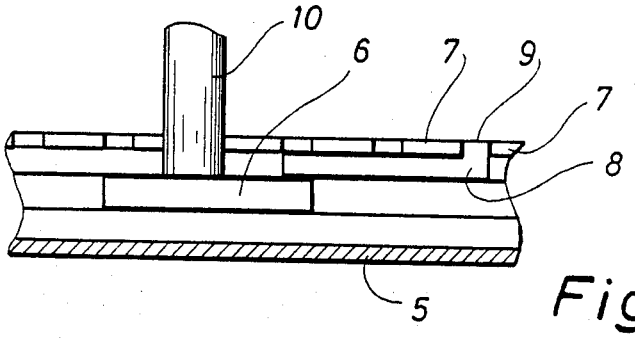
FIG. 4 is a sectional view along the line IV—IV of FIG. 2 with a holding means placed therein and also illustrating the locking menas of the device.

FIG. 4 is a sectional view of the rail 5 along the line IV—IV of FIG. 2. The rail is provided with a holding means comprising a gripping finger or ring 10, a clamping means 6 and a locking means 8. The clamping means is not shown in a sectional view. The locking means 8 comprises a web of resilient material, said web being provided with a hook 9 at the end furthest away from the gripping finger. In FIG. 4 the hook 9 is engaged between two projections 7 facing up against the side carrying the gripping fingers or rings. In principle the hook and the projections can face the two sides or one of the two sides perpendicular to the surface where the projections are positioned in FIG. 4. Instead of the embodiment of FIG. 4, where the web is pressed down, i.e. away from the rings or gripping fingers, it can also be pushed sidewise or pulled upwards for releasing the hook from the projections.

Figure 5:
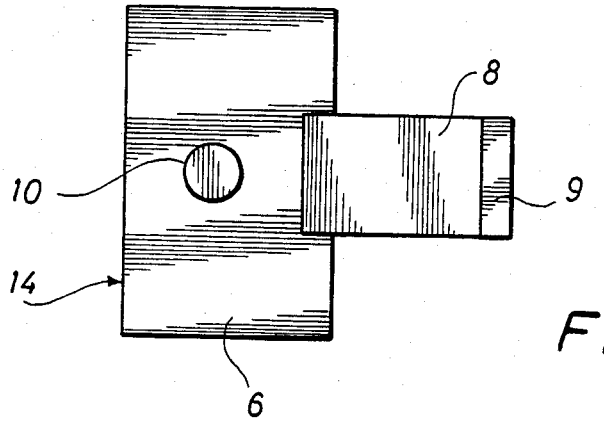
FIG. 5 is a top view of the holding means of FIG. 4.

FIG. 5 is a top view of a holding means 14 of FIG. 4, where the clamping means 6 is provided with a ring or gripping finger 10 fastened to the clamping means, as well as with a locking means comprising a web 8 and a hook 9. The locking means is shown as one web with one hook, but it can also comprise two webs with corresponding hooks facing the same side, each hook being engaged either between the same two projections or between three successive ones with two gaps inbetween. The hook can be wedge-shaped, either in one, the other or both directions. If the holding means is equipped with several locking means the holding means sits more snugly in the rail. At the same time the risk of loosening the holding means is reduced. The distance of the center of the gripping finger 10 to the center of the hook can correspond to the distance between the center of a number of projections 7 plus an additional length corresponding to one fourth of the distance between the centers of two successive projections. Thus, when the holding means 14 is turned in the rail (i.e. so that the hook and the gripping finger are inserted backwards in the rail), in the opposite direction compared to the one described above, it is possible to move the gripping finger a distance corresponding to half the distance the holding means 14 is able to be moved if the hook is only moved from one gap to one of the closest gaps. As a result it is even more easy to adapt the rings or gripping fingers to given standards. The individual ring or gripping finger 10 can also be equipped with various types of locking devices, clamping down on said rings or gripping fingers, so that the individual sheets do not move on the gripping finger when leafing through the binder. This results in a decrease of wear of the holes in the sheets kept in the binder.

Figure 6:
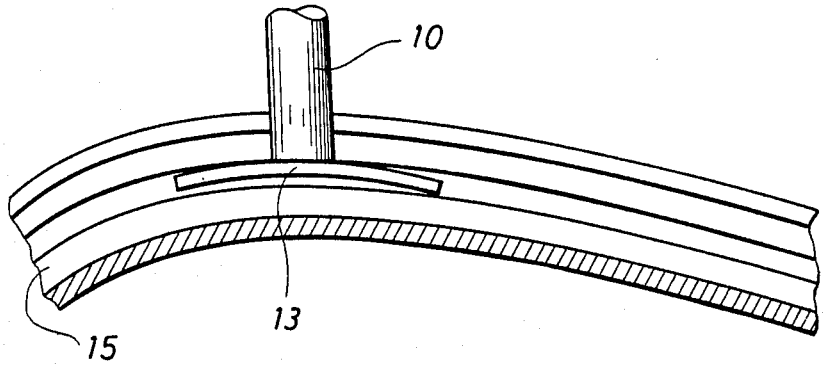
FIG. 6 illustrates a holding means placed in a rail of the type to be bent in order to release the holding means.

FIG. 6 illustrates a preferred embodiment of the invention, where the rail 15 retains the clamping means 13 by being clamped against it. When the clamping means is moved with respect ot the rail, the rail is flexed, cf. FIG. 6, thus releasing the clamping means, which can now be moved along the rail. The manner how the rail is flexed depends on the form of the binder. The rail can e.g. be bent over the edge of a table or desk or over a knee by exposing the two ends of the rail to a force, simultaneoulsy pressing the knee against the middle between the ends of the rail. The rail is flexed so that the gripping fingers face outward, i.e. radially with respect to the flexion, cf. FIG. 6. It is, however, also possible to flex the rail in a direction perpendicular to the direction of the rings or gripping fingers. It is further possible to provide the binder with mechanisms enabling the flexion of the rail. The embodiment of FIG. 6 illustrates a rail not provided with any form of projection. There can, however, be projections at one place or another in the rail, said projections meshing with notches or edges on the clamping means. The projections optionally in the rail do not necessarily have to be equidistantly spaced, but they have to be sufficiently large to effectively prevent the clamping means from moving with respect to the rail. The edges of the rail can be sharp so that the rail is cold welded, when the rail is straightened out after the clamping means has been positioned. The optional projections are positioned in such a way that the surface carrying the projections is perpendicular to the direction of flexion of the rail. This enables the release of the clamping means.

Figure 7:
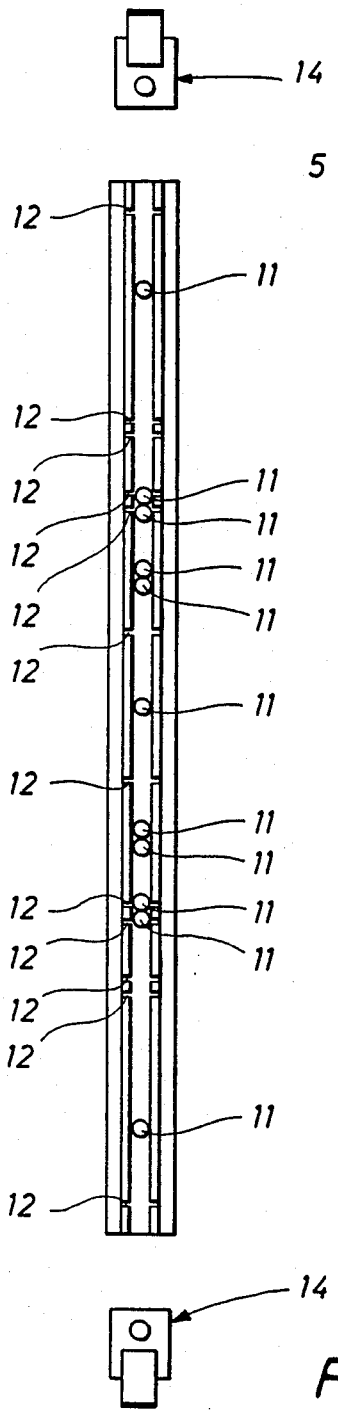
FIG. 7 illustrates a rail of the type where the projections are positioned in such a way that they are adapted to commonly used punch standards.

FIG. 7 illustrates another preferred embodiment of the rail 5. In this embodiment the projections are not equidistantly spaced but positioned in such a way that gaps 12 between the projections allow the holding means 14 to be positioned at such plates that the sheets with holes of common punch standards can be inserted correctly. The positions of the gripping fingers or rings are shown with the reference numeral 11.

The distance between the holes is a multiple of the width of a step. The width of a step is the sum of the width b of a projection and the width a of a gap between two succesive projections. The step width is suitably small so that a given distance between two successive ring positions according to any two punch standards corresponds to a predetermined number of steps.

The invention is not restricted to the above embodiments and can be altered in many ways without thereby deviating from the scope of the invention. It is thus possible to use the device for other purposes than impaling paper in a binder.

I claim:

1. A device for gathering loose leaves comprising a loose leaf binder having at least one rail mounted thereon, at least two holding means provided with rings detachably fastened to said rail, said holding means being mutually displaceable with respect to said rail and said rings being adapted to be opened and closed, and means for detachably fastening said holding means to said rail comprising locking means placed on the holding means having a resilient web, at least one part of which is easily accessible to a user from above the rail facing the holding means, said locking means being meshable between two projections of a row of projections positioned on one side of said rail facing said holding means so that said holding means is retainable in a desired position, the meshing being substantially dependent on the position of the holding means.

2. A device according to claim 1, wherein the holding means each comprise means provided with a respective ring and locking means, said clamping means having a length extending in the longitudinal direction of the rail which is shorter than its width transeversely thereto.

3. A device according to claim 1, wherein said rail has projections positioned along the entire length thereof in two rows.

4. A device according to claim 1, wherein the projections of said row are mutually parallel.

5. A device according to claim 1, wherein the projections of said row are positioned with a mutual distance adapted to different punch standards.

6. A device according to claim 1, wherein said binder comprises two board parts and one back part, and there are two rails each mounted on one board part, or both rails are mounted on the back part, or the two rails are mounted in such a way that one is mounted on the back part and the other is mounted on one of the board parts.

7. A device according to claim 1 wherein the resilient web of the locking menas is provided with a hook close to the end of said web furthest away from an associated ring, said hook being meshable between said projections and being removable from said two projections when the web is pressed down into a groove between said projections by manually exerted pressure on the middle of the web.

8. A device according to claim 1, wherein said projections are rectangular as seen from above.

9. A device according to claim 1, wherein said projections are equidistantly spaced.

10. A device according to claim 7, wherein said hook is wedge-shaped as seen from above.

* * * * *